US007402024B2

(12) United States Patent
Kriz et al.

(10) Patent No.: US 7,402,024 B2
(45) Date of Patent: Jul. 22, 2008

(54) STEAM TURBINE

(75) Inventors: Davor Kriz, Baden (CH); Peter John Walker, Stetten (CH)

(73) Assignee: ALSTOM Technology Ltd., Baden (CH)

( * ) Notice: Subject to any disclaimer, the term of this patent is extended or adjusted under 35 U.S.C. 154(b) by 227 days.

(21) Appl. No.: 11/275,934

(22) Filed: Feb. 6, 2006

(65) Prior Publication Data

US 2007/0207031 A1 Sep. 6, 2007

(30) Foreign Application Priority Data

Feb. 16, 2005 (CH) ..... 0273/05

(51) Int. Cl.
*F01D 25/26* (2006.01)

(52) U.S. Cl. ..... 415/213.1; 415/214.1

(58) Field of Classification Search ..... None
See application file for complete search history.

(56) References Cited

U.S. PATENT DOCUMENTS 6,572,328 B2 * 6/2003 Tremmel et al. ..... 415/1

FOREIGN PATENT DOCUMENTS

| | | |
|---|---|---|
| DE | 3420389 | 12/1985 |
| EP | 0965732 | 12/1999 |

OTHER PUBLICATIONS

Busse, L., et al., "World's highest capacity steam turbosets for the lignite-fired Lippendorf power station," ABB Review 1997, pp. 13-22, Bd. 63, Nr. 6, ABB Asea Brown Boveri, Zurich Switzerland.
Search Report for Swiss Patent App. No. CH 2732005, dated May 20, 2005.

* cited by examiner

*Primary Examiner*—Richard Edgar
(74) *Attorney, Agent, or Firm*—Cermak Kenealy & Vaidya LLP; Adam J. Cermak

(57) ABSTRACT

A steam turbine (20), in particular for high pressure and/or intermediate pressure applications, has a rotor (11), which can rotate about an axis (23), an inner casing (14), which concentrically surrounds the rotor (11) at a distance, so as to form an annular passage (12) extending in the axial direction, and an outer casing (13), which concentrically surrounds the inner casing (14) at a distance so as to form an annular intermediate space (16) extending in the axial direction, blading including rotor blades (21) and guide vanes (22) being provided in the annular passage (12), and the annular passage (12), on the outlet side, being in communication with the intermediate space (16) in order for the steam to be passed on, and the inner casing (14) also being externally surrounded by a plurality of shrink rings (15), which are arranged one behind the other in the axial direction and project into the intermediate space (16). In a steam turbine of this type, the aerodynamics are improved by virtue of the fact that a device (24) is provided for leveling the finned structure produced by the shrink rings (15) on the outer side of the inner casing (14), in such a manner that the annular intermediate space (16) is delimited on the inner side by a continuously smooth inner surface which is favorable in terms of fluid dynamics.

3 Claims, 3 Drawing Sheets

STEAM TURBINE

This application claims priority to Swiss application number 00273/05, filed 16 Feb. 2005, the entirety of which is incorporated by reference herein.

BACKGROUND OF THE INVENTION

1. Field of the Invention

The present invention deals with the field of steam turbines.

A steam turbine of this type is known, for example, from EP-A1 0 965 732 or from the article by L. Busse and K. -H. Soyk "World's highest capacity steam turbosets for the lignite-fired Lippendorf power Station", ABB Review June 1997, pp. 13-22 (cf the HP turbine in FIG. 2 of that document).

2. Brief Description of the Related Art

Shrink rings which surround the inner casing of the steam turbine, holding it together and mechanically stabilizing it under the high pressures which occur, are used in steam turbines designed for high pressure or intermediate pressure, the blade passages of which have a relatively small cone angle.

One example of a configuration of a steam turbine of this type from the prior art, as is known from the article in ABB Review cited in the introduction, is illustrated in FIG. 1. The steam turbine 10 illustrated in FIG. 1 includes a rotor 11, which is mounted in two bearings 19, 19' such that it can rotate about an axis 23. The rotor 11 is surrounded concentrically at a distance by an inner casing 14. An annular passage 12 remains clear between the rotor 11 and the inner wall of the inner casing 14, and the blading made up of rotor blades and guide vanes (21 and 22 in FIG. 3) is accommodated in this annular passage 12, through which the steam, which enters the right-hand end of the annular passage 12 radially through a live steam inlet 18, flows (from right to left in FIG. 1). For its part, the inner casing 14 is concentrically surrounded at a distance by an outer casing 13, so as to form an annular intermediate space 16 which extends approximately parallel to the annular passage 12 and is connected to the annular passage 12 at the outlet side. In operation, the steam enters the annular passage 12 through the live steam inlet 18, flows through the annular passage 12 from right to left, performing work as it does so, is diverted at the left-hand end and then flows through the intermediate space 16 to an outlet before then leaving the steam turbine 10 for further use (for example in a subsequent intermediate-pressure stage).

The inner casing 14 is of multi-part design and usually includes an upper part and a lower part which, after assembly, are held together by externally encircling shrink rings 15. For this purpose, a plurality of shrink rings 15 are distributed in succession in the axial direction over the length of the inner casing 14 (cf also EP -A1 0 965 732). In the case of the known steam turbine 10 illustrated in FIG. 1, the additional radial distance to the annular passage 12 produced by the shrink rings 15 is utilized in order to provide a heat shield 17, which reduces the temperature difference between the inner side and outer side of the inner casing 14 in the region of the steam inlet and therefore also reduces the thermal stresses at the inner casing 14, in the region of the particularly high inlet temperatures. The shield 17 includes a cylindrically bent metal sheet, which, bearing against the outer circumference of the shrink rings 15, surrounds approximately the right-hand half of the inner casing 14 and is thereby restricted to a particularly highly stressed portion of the inner casing 14. In the left-hand portion of the inner casing 14, which is not surrounded by the shield, the shrink rings 15 project unimpeded, in the form of fins, into the intermediate space 16, where they considerably impede the flow of steam flowing within the intermediate space 16.

SUMMARY OF THE INVENTION

One aspect of the present invention includes modifying a steam turbine of the type described in the introduction in such a way that the flow of steam in the intermediate space between inner casing and outer casing is significantly improved in terms of fluid dynamics.

According to another aspect of the present invention, means are provided for leveling the finned structure produced by the shrink rings on the outer side of the inner casing, in such a manner that the annular intermediate space is delimited on the inner side by a continuously smooth inner surface which is favorable in terms of fluid dynamics.

In yet another aspect embodying principles of the present invention, the annular recesses between adjacent shrink rings and in the end regions are filled or covered in such a way that an axially smooth and continuous wall region, which is favorable in terms of fluid dynamics, is formed on the inner side of the intermediate space 16.

A wall surface which is favorable in terms of fluid dynamics can be produced in a particularly simple way if, according to one exemplary configuration of the invention, the leveling means comprises a cylindrical shroud which surrounds all the shrink rings. In particular, the shroud may extend over the entire axial length of the inner casing and may be connected to the inner casing at the ends. A shroud of this type can at the same time effect an advantageous thermal insulation of the inner casing, which considerably reduces the thermal stresses at the inner casing.

According to a refinement of this configuration, the shroud comprises a cylindrically curved metal sheet and bears against the outer circumference of the shrink rings.

BRIEF DESCRIPTION OF THE DRAWINGS

The invention is to be explained in more detail below on the basis of exemplary embodiments in conjunction with the drawing, in which.

DETAILED DESCRIPTION OF EXEMPLARY EMBODIMENTS

Figure 1:
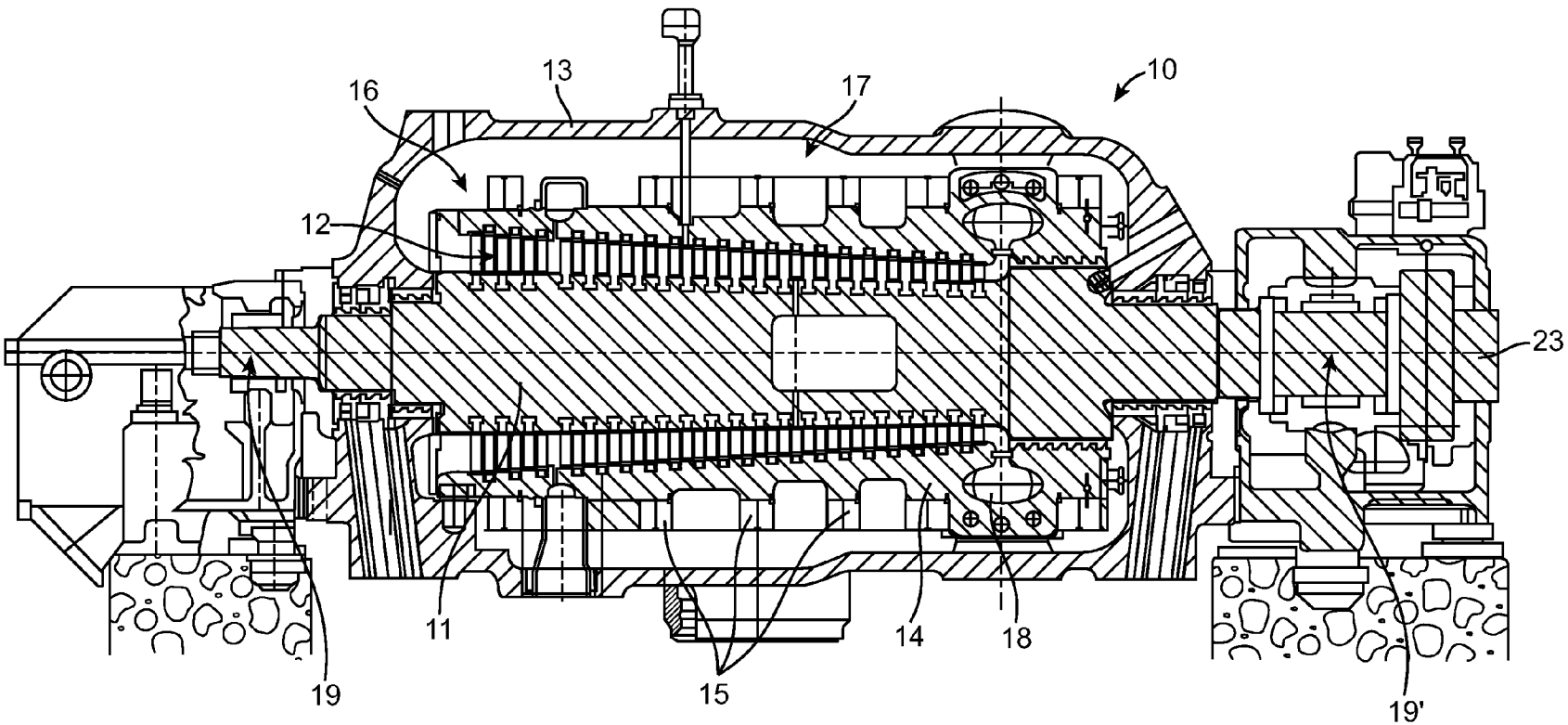
FIG. 1 (PRIOR ART)
FIG. 1 shows a longitudinal section through a high-pressure steam turbine with an inner casing held together by shrink rings and a thermal insulation of the inner casing in accordance with the prior art.
Figure 2:
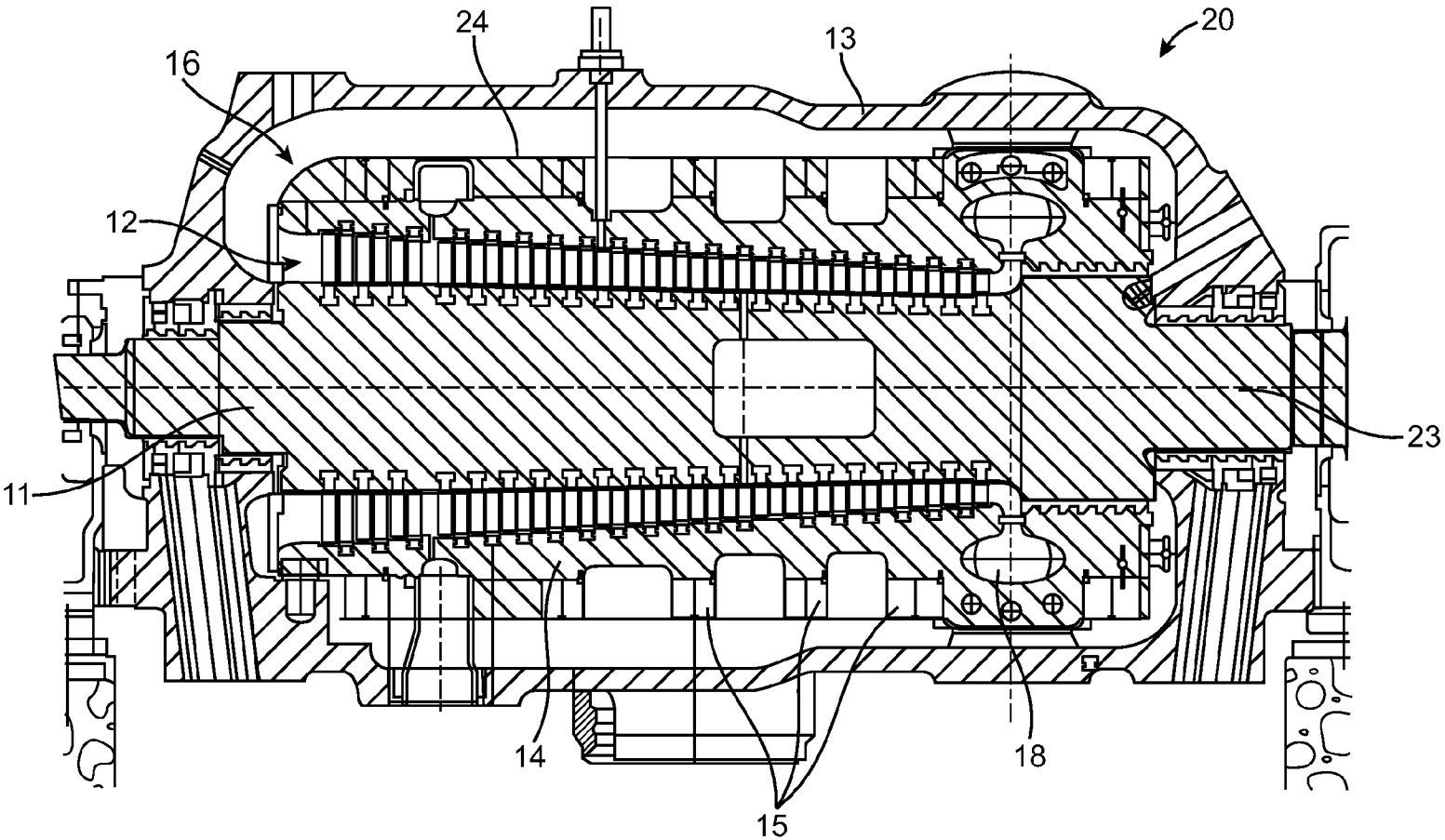
FIG. 2 shows an illustration comparable to that of FIG. 1 of an exemplary embodiment of a steam turbine according to the invention, with improved fluid dynamics in the intermediate space between inner casing and outer casing.
Figure 3:
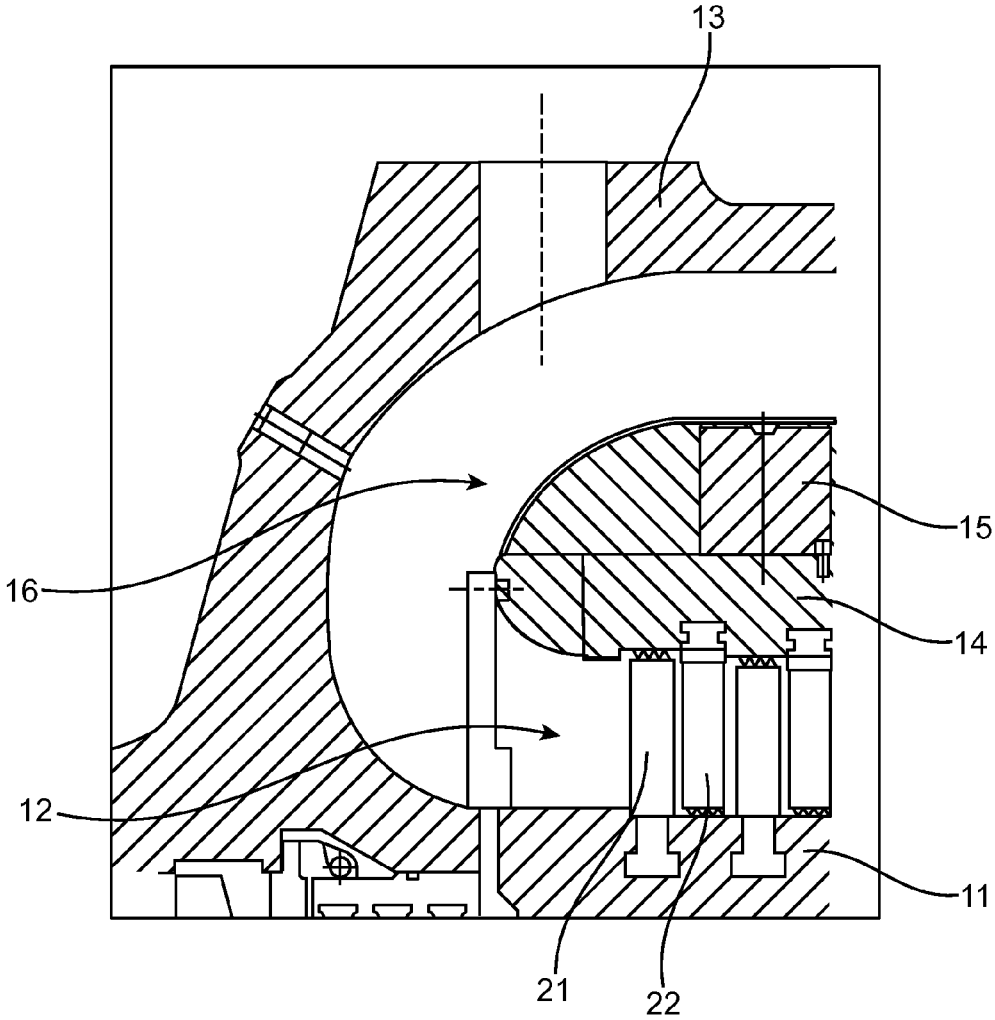
FIG. 3 shows an enlarged excerpt from the illustration presented in FIG. 2, showing the region where the flow of steam is diverted between the outlet of the annular passage and the inlet of the intermediate space between inner casing and outer casing.

FIG. 2 shows, in an illustration comparable to that presented in FIG. 1, an exemplary embodiment of a steam turbine 20 according to the invention with an intermediate space of improved fluid dynamics between inner casing and outer casing. Identical parts are provided with the same reference designations as in FIG. 1. The difference with respect to FIG. 1 is that the inner casing 14 with its fin-like shrink rings 15 is now surrounded over the entire axial length by a cylindrical shroud 24, which bears against the outside of the shrink rings 15 and forms a smooth inner wall which is favorable in terms of fluid dynamics for the intermediate space 16. Since in the example shown the shrink rings 15 all have the same external diameter, the shroud 24 has the same external diameter over the entire length of the inner casing 14 and narrows only at the outlet-side end of the inner casing 14 (FIG. 3), in order to be smoothly connected there to the inner casing 14. The shroud 24 runs approximately parallel to the inner wall of the outer casing 13.

The entire shroud 24 for the inner casing 14 including its shrink rings 15 can be regarded as an extension of the shield 17 from FIG. 1 to the entire axial length of the inner casing 14. In particular, the same metal sheet used for the shield 17 can also be used for this purpose. Accordingly, the shroud then has a dual function:

- it reduces the temperature difference and therefore the thermal stresses between inner wall and outer wall of the inner casing 14.
- it acts as part of the diffuser which follows the annular passage, and on account of the uniform and smooth cylindrical wall surface makes a very considerable contribution to improving the aerodynamics in the intermediate space 16.

LIST OF DESIGNATIONS

| | |
|---|---|
| 10, 20 | Steam turbine |
| 11 | Rotor |
| 12 | Annular passage |
| 13 | Outer casing |
| 14 | Inner casing |
| 15 | Shrink ring |
| 16 | Intermediate space |
| 17 | Shield |
| 18 | Live steam inlet |
| 19, 19' | Bearing |
| 21 | Rotor blade |
| 22 | Guide vane |
| 23 | Axis |
| 24 | Shroud (inner casing) |

While the invention has been described in detail with reference to exemplary embodiments thereof, it will be apparent to one skilled in the art that various changes can be made, and equivalents employed, without departing from the scope of the invention. Each of the aforementioned documents is incorporated by reference herein in its entirety.

What is claimed is:

1. A steam turbine useful for high pressure applications, intermediate pressure applications, or both applications, the steam turbine comprising:

a rotor which can rotate about an axis;

an inner casing which concentrically surrounds the rotor at a distance to form an annular passage extending axially;

an outer casing which concentrically surrounds the inner casing at a distance to form an annular intermediate space extending axially;

blading comprising rotor blades and guide vanes in the annular passage;

wherein the annular passage includes an outlet side in fluid communication with the annular intermediate space in order for steam to be passed from the annular passage to the annular intermediate space;

a plurality of shrink rings axially arranged one behind the other and projecting into the intermediate space to form a finned structure, the plurality of shrink rings externally surrounding the inner casing;

means for leveling the finned structure formed by the shrink rings on the outer side of the inner casing such that the annular intermediate space is delimited on the inner side by a continuously smooth inner surface; and wherein the means for leveling comprises a cylindrical shroud which surrounds all the shrink rings.

2. The steam turbine as claimed in claim 1, wherein the inner casing has an axial length and ends, and wherein the cylindrical shroud extends over the entire axial length of the inner casing and is connected to the inner casing at said ends.

3. The steam turbine as claimed in claim 1, wherein the shrink rings define an outer circumference, and wherein the cylindrical shroud comprises a cylindrically bent metal sheet and bears against the outer circumference of the shrink rings.

* * * * *